US007282232B2

(12) United States Patent
Rose et al.

(10) Patent No.: US 7,282,232 B2
(45) Date of Patent: Oct. 16, 2007

(54) BONDED FIBROUS SHEET MATERIAL

(76) Inventors: John Edward Rose, 2 Bromley Green, Chorley, Lancashire (GB) PR6 8TX; Glynn Arthur Wardle, 103 Long La., Bolton, Lancashire (GB) B12 6EU ( * ) Notice: Subject to any disclaimer, the term of this patent is extended or adjusted under 35 U.S.C. 154(b) by 523 days.

(21) Appl. No.: 10/451,808

(22) PCT Filed: Jan. 17, 2002

(86) PCT No.: PCT/GB02/00165

§ 371 (c)(1),
(2), (4) Date: Oct. 23, 2003

(87) PCT Pub. No.: WO02/057545

PCT Pub. Date: Jul. 25, 2002

(65) Prior Publication Data

US 2004/0096554 A1 May 20, 2004

(30) Foreign Application Priority Data

Jan. 19, 2001 (GB) ..... 0101395.2

(51) Int. Cl.
*A23P 1/08* (2006.01)

(52) U.S. Cl. ..... 426/135; 426/105; 426/138; 162/164.3; 162/207; 428/36.4; 428/36.5

(58) Field of Classification Search ..... None
See application file for complete search history.

(56) References Cited

U.S. PATENT DOCUMENTS

| | | | | |
|---|---|---|---|---|
| 4,207,353 | A * | 6/1980 | Rasmussen et al. | 426/513 |
| 4,299,654 | A * | 11/1981 | Tlach et al. | 162/164.3 |
| 5,690,790 | A * | 11/1997 | Headlam et al. | 162/175 |
| 5,718,804 | A * | 2/1998 | Jansen et al. | 162/164.6 |
| 5,912,306 | A * | 6/1999 | Pudney et al. | 525/430 |
| 6,319,361 | B1 * | 11/2001 | Smith et al. | 162/146 |
| 6,582,559 | B2 * | 6/2003 | Thornton et al. | 162/175 |
| 6,896,725 | B2 * | 5/2005 | Thornton et al. | 106/162.1 |

FOREIGN PATENT DOCUMENTS

| | | | |
|---|---|---|---|
| WO | WO9510190 | * | 4/1995 |
| WO | WO9934058 | * | 7/1999 |

OTHER PUBLICATIONS

Espy, H. H. 1995. TAPPI Journal, Apr. 1995, p. 90-97.*

* cited by examiner

*Primary Examiner*—Carolyn Paden
(74) *Attorney, Agent, or Firm*—Dann, Dorfman, Herrell and Skillman, P.C.; Patrick J. Hagan, Esq.

(57) ABSTRACT

The present invention refers to a method of producing a porous bonded fibrous sheet material comprising: (i) treating a porous fibrous substrate which is comprised of cellulosic fibers and which has a moisture content of less than 10% by weight with a gum and a cross-linkable wet strength resin both dissolved in water; (ii) removing excess water; and (iii) effecting cross-linking of the resin.

27 Claims, 5 Drawing Sheets

VISCOSE DRAW DOWN SIMULATION DIAGRAM

Current none viscose binder system invention gives no Fracture Lines in either the Coagulation or Regeneration stages of the casing process which emulates a typical viscose binder system.

Paper ( i ) — Invention

VISCOSE DRAW DOWN SIMULATION DIAGRAM

No Fracture lines created in either the Coagulation or Regeneration stages of casing process which is typical of viscose binder systems.

Paper (ii) — Viscose Binder

VISCOSE DRAW DOWN SIMULATION DIAGRAM

Fracture lines created in both the Coagulation and Regeneration stages of the casing process which is typical of certain none viscose binder systems.

Paper (iii) – PVOH Binder

PAPRICAN BRISTOW DYNAMIC SORPTION ANALYSIS

Viscose Absorption @ 3580 cp

| Contact Time ms | NVB#1 (Dialdehyde) | NVB#2 (PVOH1) | NVB#3 (PVOH2) | T#1 (Gum) | VB (Viscose) |
|---|---|---|---|---|---|
| 200 | 32.0 | 28.5 | 27.4 | 24.9 | 19.4 |
| 400 | 40.4 | 30.0 | 28.9 | 27.8 | 18.5 |
| 800 | 46.9 | 36.0 | 34.7 | 32.6 | 22.6 |
| 2000 | 53.5 | 45.9 | 44.7 | 44.2 | 31.4 |
| 3030 | 67.5 | 53.1 | 52.1 | 50.5 | 36.8 |
| 4000 | 68.0 | 59.0 | 58.0 | 57.0 | 44.4 |
| 5000 | 68.1 | 59.0 | 58.5 | 57.6 | 52.1 |
| 6250 | 68.1 | 59.0 | 58.5 | 57.6 | 52.1 |

PAPRICAN BRISTOW DYNAMIC SORPTION ANALYSIS

VISCOSE ABSORPTION AT VARIOUS VISCOSITY POINTS.

| Contact Time ms | 970 CP | 1820CP | 3580CP |
|---|---|---|---|
| 80 | 34.2 | | |
| 200 | 42.2 | 32.1 | 24.9 |
| 400 | 51.3 | 38.8 | 27.8 |
| 800 | 63.5 | 44.4 | 32.6 |
| 1490 | 78.4 | | |
| 2000 | 76.6 | 62.3 | 44.2 |
| 3030 | | 72.6 | 50.5 |
| 3448 | | 74.1 | |
| 4000 | | 59.0 | 57.0 |
| 5000 | | | 55.6 |

BONDED FIBROUS SHEET MATERIAL

BACKGROUND OF THE INVENTION

The present invention relates to a bonded fibrous sheet material which is useful, for example, in the manufacture of casings (e.g. skins) for food products.

It is well known that number of food products (particularly certain meat products) are, during their process of manufacture, enclosed within a skin which retains the form or shape of the product. Examples of such food products are sausages, salami etc.

One method which has been used extensively for producing such casings involves viscose treatment of a porous paper web, as described more fully in U.S. Pat. No. 3,135,613. Briefly this process involves the steps of (a) forming a bonded fibrous web by treatment of the paper with a dilute viscous solution (to apply approximately 1-3% of viscose based on the weight of the paper), drying the web, regenerating cellulose by acid treatment, washing and further drying. The product of this step is a porous, bonded fibrous web having sufficient caustic resistance to withstand the highly alkaline conditions of step (b). Conventionally step (a) has been carried out by the manufacturer of the paper; and (b) treating the bonded web obtained from step (a) with a highly caustic viscose solution (to apply 300%-400% of viscose by weight of the paper), followed by regeneration of cellulose and washing and drying steps to produce the food casing material.

The product of step (a) has properties rendering it highly desirable for use as a food casing. More particularly, the casings are:

1. porous and permeable to moisture vapor and smoke thus allowing food products enclosed therein to be processed;

2. dimensionally stable to allow food products which may for example be salami of substantial lengths and relatively heavy to be hung without losing their shape; and 3. clear to the extent that the fibrous base cannot be seen.

Such casings are perfectly satisfactory and have been used for many years. However step (1) does have processing disadvantages in that it is a multi-stage process involving dope addition, acidification, neutralisation and washing stages. The multi-stage process associated with step (3) is an accepted process requirement in the industry and is not seen as a particular disadvantage.

Various patents have discussed the use of alternative materials for bonding paper webs to provide an appropriate substrate for casing forming operations where treatment with concentrated viscose solution under highly alkaline conditions is carried out. After undergoing bonding the substrate must retain its porous, absorbent characteristics in order to permit adequate impregnation and encasement by the converted viscose. The bonding agent should also be one that will not cause the substrate to become discoloured during exposure to the conditions of the casing forming process.

U.S. Pat. No. 3,484,256 (Chiu et al) suggests cationic thermosetting resin and polyacrylamide as a replacement for the dilute viscose bonding treatment. U.S. Pat. No. 3,640,734-5 (Conway), and U.S. Pat. No. 3,679,437 (Oppenheimer et al) teach the use of soluble poly (vinyl alcohol) as a wet strengthening agent.

The aforementioned binder materials, whether used alone or in combination frequently provide some but not all of the desired characteristics of the casing. For example the use of poly (vinyl alcohol) having a degree of hydrolysis of about 85% will provide low to moderate dry tensile strengths but poor wet tensile, caustic strength and absorption characteristics. Conversely, the use of fibrous film forming materials such as hydroxyethyl cellulose in conjunction with appropriate cross linking agent such as dialdehyde cross linkers will have the opposite effect from that achieved by the poly(vinyl alcohol). They exhibit good wet tensile strengths and absorbency characteristics but poor caustic tensile strength. Unfortunately, mixtures of these materials also fail to provide all the desired characteristics.

JP-A-6294094 (Oji Paper Co) discloses manufacture of a paper which is stated to have good wet strength and good alkali resistance and which is suitable for use as a casing for a meat product (e.g. ham or sausage) or in the manufacture of tea bags. The paper is produced by adding guar gum and a polyamide epichlorohydrin resin (a wet strength agent) to the wet end of the paper making process. We have however found that papers using this technique do not actually have sufficient wet tensile strength and caustic tensile strength for consistent conversion to food casing material in step (b) outlined above.

WO-A-9510190 (J. R. Crompton Limited) discloses a bonding fibrous sheet material suitable for conversion, by viscose treatment, into a food casing material. The bonded fibrous sheet material is produced by treatment of a porous fibrous substrate (particularly a paper) with a coating composition which under the conditions of the treatment does not form a film and which is an admixture of a polymer latex and a wet strength resin, and effecting cross-linking of the polymer and resin to produce the porous bonded, fibrous sheet material. It is contemplated in WO-A-9510190 that the coating composition may include a fibre consolidation aid, e.g. in an amount of less than 3% by weight of the coating composition. The preferred fibre consolidation aid is carboxymethyl cellulose and other examples given include galactomannan, e.g. guar gum and locust bean gum. We have however found that this binder system can still cause fracture lines and poor body penetration if the latex component is over or under cured. Furthermore, preferred impregnants in accordance with WO-A-9510190 include a surfactant (in addition to the latex and wet-strength resin) and if the surfactant level is not correctly controlled in the impregnant then there is an adverse impact on fracture line propagation.

SUMMARY OF THE INVENTION

It is therefore an object of the present invention to obviate or mitigate the above mentioned disadvantages and provide a method of producing a bonded web having characteristics associated with dilute viscose bonded materials.

According to a first aspect of the present invention there is provided a method of producing a porous bonded fibrous sheet material comprising (i) treating a porous fibrous substrate which is comprised of cellulosic fibres and which has a moisture content of less than 10% by weight with a gum and a cross-linkable wet strength resin both dissolved in water, said treatment being effected otherwise than with a latex;

(ii) removing excess water; and (iii) effecting cross-linking of the resin.

According to a second aspect of the present invention there is provided a porous bonded fibrous sheet material produced by the method of the first aspect of the invention.

DETAILED DESCRIPTION OF THE INVENTION

Figure 1:
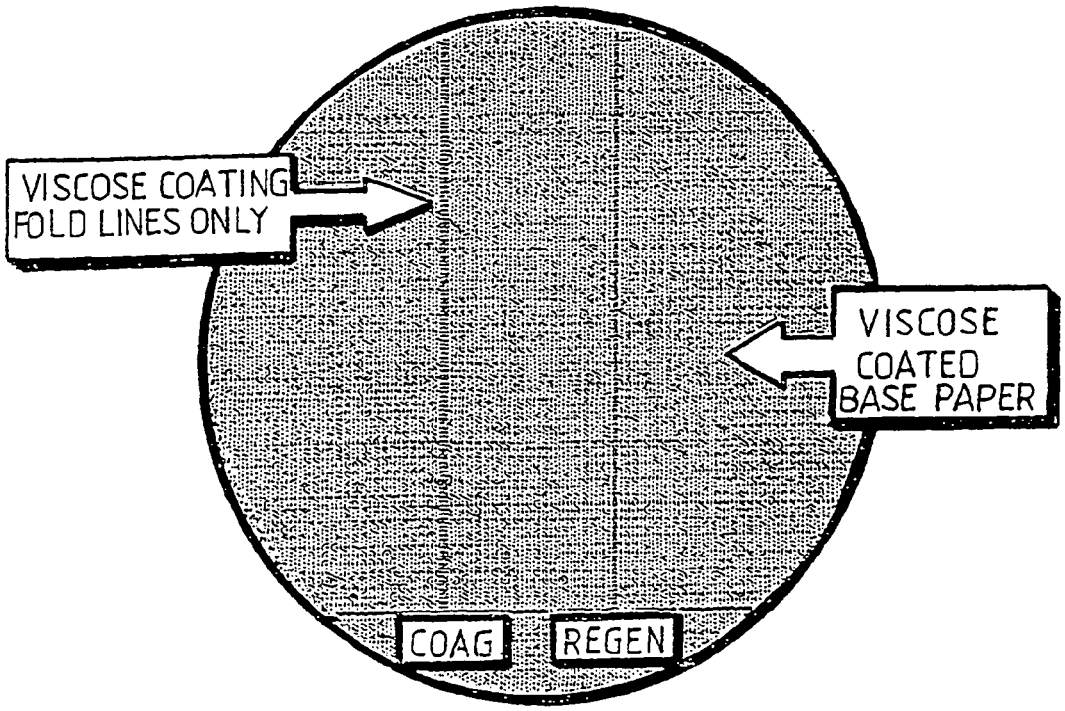
FIGS. 1-3 illustrate the results of tests done on the paper samples in Example 3.

The porous fibrous substrate will generally be a wet-laid material, particularly a paper. The paper (or other porous fibrous substrate) to be treated has a moisture content of less than 10% by weight, more preferably less than 5%, e.g. 3-5%, and as such is generally referred to in the industry as being "bone-dry" (although it does contain the indicated amount of moisture). We have found that use of a gum and a wet strength resin to treat the "dry" (i.e. less than 10% moisture) porous fibrous substrate provides a bonded material having significantly improved wet tensile strength and caustic tensile strength as compared to a material produced by a wet-laying process involving addition of a gum and a wet strength resin only at the wet end of the process (i.e. as disclosed in JP-A-6294094). Whilst we do not wish to be bound by theory we believe that during cross-linking of the wet strength resin both the gum and the cellulose (of the fibres) are also involved in cross-linking. As a result, the wet-strength resin, the gum and the cellulose are cross-linked together and it is this cross-linking which provides the improved properties for the bonded material. Surprisingly also the properties of the material (in accordance with the second aspect of the invention) are improved compared to those obtained with the procedure of WO-A-9510190, even though a much simplified binding system is used (i.e. without latex). Compared to the preferred materials of WO-A-9510190, materials produced in accordance with the invention typically have in total dry tensile, total wet tensile and total caustic tensile of 29%, 23% and 33% respectively. Materials in accordance with the invention also have much improved absorbency.

Bonded fibrous sheet materials in accordance with the second aspect of the invention are eminently suitable for conversion into a food casing material by a viscose treatment (i.e. step (b) above) as employed in the prior art conversions of viscose pre-treated paper or any other suitable material.

Therefore according to a third aspect of the present invention there is provided a food casing material which comprises the bonded fibrous sheet material in accordance with the second aspect of the invention treated with viscose.

Typically the food casing material will comprise 300%-400% of viscose by weight of the base porous substrate.

Food casing materials produced in accordance with the third aspect of the invention meet requirements (1)-(3) above. Furthermore the bonding which is achieved between the viscose and the cross-linked coating composition results in lower levels of stress line fracture normally associated with resin bonded casing substrates. Additionally the food casing materials have improved stretch characteristics and casing clarity when compared to other resin bonded systems, with the resultant clarity being comparable to that of materials obtained using viscose pre-treated substrates.

According to a fourth aspect of the present invention there is provided a food product (e.g. a meat product such as a sausage or salami) enclosed within a food casing material in accordance with the third aspect of the invention.

In addition to its use in the manufacture of food casing materials, the bonded web material of the invention may be used in the production of beverage filtration products, e.g. tea bags, coffee bags etc. The material is also useful in the production of sachets for washing powders and double-sided adhesive tapes.

In practising the method of the first aspect of the invention, the porous fibrous substrate will preferably be treated with an aqueous solution which contains both the gum and the cross-linkable wet strength resin dissolved in water. We do not however preclude the possibility of treating the substrate with separate solutions of the gum and the resin. The solution(s) applied to the fibrous substrate is/are non-film forming (under the conditions of treatment) to ensure that the bonded material ultimately obtained is porous.

Preferably the total amount of the gum and wet strength resin applied to the porous fibrous substrate is less than 10% (e.g. 1 to 10%) by weight of the untreated substrate. Typically the amount of the wet strength resin applied to the substrate will be less than 5%, usually 0.05-2%, by weight of the untreated substrate. Typically also the amount of gum applied to the substrate will be 0.05%-3% on the same weight basis.

Preferably the gum is non-ionic. Preferably the gum is a galactomannan gum and is most preferably unsubstituted. The gum will generally be a vegetable gum. Examples of gums that may be used in the present invention include guar gum and locust bean gum which are widely used as formation aids in paper making processes by addition to the wet end of the process.

A range of wet strength resins may be used. If however it is intended that the final precursor material be subsequently treated with viscose to produce the finished food casing then the final wet strength system should be alkali resistant.

Suitable wet strength resins are water soluble cationic epichlorohydrin polyamide products, e.g. Kymene 709 as available from Hercules Ltd. which becomes alkali resistant in combination with the gum (Kymene is a Registered Trade Mark).

Preferably the porous substrate is a wet laid fibrous substrate, most preferably a paper. Most preferably the paper is of a high and uniform permeability (preferably 100-200 $m^3\ min^{-1}\ m^{-2}$) and of low basis weight (typically 10-30 gsm). Preferably also the paper has a tensile ratio (i.e. ratio of machine direction:cross direction strength) of 0.5-2.0 more preferably in the range 1.0-1.5. The paper is ideally prepared from "long" fibres (e.g. 5 mm) of high aspect ratio (e.g. 300-3000). The web's constituent fibres should also exhibit uniform formation and absorbency characteristics. Particularly suitable papers are composed entirely of natural cellulosic fibres typically of the Musa Textilis species (e.g. Abaca). It is also possible to use papers comprised partially of synthetic fibres.

Preferred papers for use (as the porous fibrous substrate) to be treated in accordance with the first aspect of the invention are manufactured with the addition of a gum and a wet strength resin to the wet end of the paper making process (in addition to the gum and wet strength resin applied to the "dry" paper). The amount of gum included in the as-manufactured paper (i.e. prior to treatment in accordance with the first aspect of the invention) is preferably 0.5% to 2.5% by weight and the amount of wet strength resin in the "as-manufactured" paper is preferably 0.3% to 1.5%.

In the case where the porous fibrous substrate to be treated in accordance with the first aspect of the invention is a paper then such treatment may be effected after drying of the paper web (formed on the paper making fabric or wire) to a moisture content of less than 10% (typically 3-5%) as conventionally happens in paper manufacture. The treatment is conveniently effected by application of a solution comprising the gum and the wet strength resin by means of a size press although other methods of impregnating the substrate may be used, e.g. spraying or immersion. In any such treatment, the amount of the solution applied to the web will be controlled so that, after drying, the required amount of gum and wet strength resin remain on the paper.

Drying of the paper that has been treated with the solution (containing the gum and wet strength resin) may be effected using a drying cylinder, through air/float air dryer of the like.

Cross-linking of the wet-strength resin may be effected by heating, typically to a temperature above 100° C., usually 200-300° C. and typically 220-250° C.

The invention will be illustrated with reference to the following non-limiting Examples and FIGS. 1-5 of the accompanying drawings which illustrate the results of Examples 3 and 4.

EXAMPLE 1

An Abaca paper was produced on a pilot papermaking machine. The paper had an Abaca paper having a basis weight of about 23.5 gsm (average fibre length ca 5 mm, aspect ratio 300-3000), a moisture content of about 4% by weight and contained 0.5% by weight Kymene and 2% by weight guar gum (ex Rhodia) incorporated during wet-laying.

The paper was then size pressed with an aqueous solution comprising

| | |
|---|---|
| [1]Guar Gum (ex Rhodia) | 0.25% by weight |
| Kymene 709 (ex Hercules) | 0.5% by weight |
| Water | Balance |

([1]Meypro Guar CSA 200/50).

The size press was adjusted so that the paper was impregnated with its own weight of the coating composition (solids content 0.75%).

The paper was dried to a moisture content of about 4% using a combination of drying cylinder and through air drying methods on the pilot papermaking machine and was then heated to a temperature of 150° C. by an air flotation curing oven to cure the binder system. The physical properties of the web thus obtained are listed in Table 1.

TABLE 1

| [2]Total Wet Tensile g/15 mm | [2]Total Caustic Tensile g/15 mm |
|---|---|
| 720 | 402 |

[2]MD:CD = ca 1.5

The value for wet tensile strength and caustic tensile strength compare with values of 198-432 g/15 mm and 61-120 g/15 mm respectively as obtained in Examples 1-3 of JP-A-6294094 (Oji Paper Co.) where Guar Gum and polyamide epichlorohydrin are only added to the wet end of the paper making process.

EXAMPLE 2

Example 1 was repeated save that the paper was size pressed with the following solution:

| | |
|---|---|
| Guar Gum (ex Rhodia) | 0.5% by weight |
| Kymene 709 (ex Hercules) | 0.9% by weight |
| Water | Balance |

The properties of the material obtained are shown in Table 2.

TABLE 2

| [2]Wet Tensile g/15 mm | [2]Caustic Tensile g/15 mm |
|---|---|
| 1358 | 757 |

[2]MD:CD = ca 1.5

EXAMPLE 3

Viscose Draw Down (Penetration) Analysis

This test was carried out on the following paper samples:

(i) the paper of Example 2;

(ii) an Abaca paper having a viscose binder;

(iii) an Abaca paper having a poly(vinyl alcohol).

An A4 sample of the paper was taken and a base line drawn 2" from the bottom of the sample in portrait orientation. On this line roughly 4 inches to the left of centre of the sheet a small vertical line was made and marked as COAG. The same mark was made to the right of the centre and marked as REGEN.

The sample was then laid flat on a glass plate and using a circa 2 mm coating bar a concentrated viscose solution was laid evenly across the sample.

The sample was carefully transferred to a bath containing the coagulant chemicals (typically sulphuric acid, sodium sulphate and ammonium sulphite) at a strength to achieve ca 60% regeneration and left for 30 seconds to start initial coagulation. The sample was then carefully folded along the COAG mark so as to place the viscose coated faces together. The fold was then reinforced by running a standard ink spreading roller up and down the fold three times. The sample was then laid flat again in the COAG bath for a further 2.5 minutes to finish coagulation.

The sample was then carefully transferred to the regeneration chemical bath (sulphuric acid) at a strength sufficient to achieve 99% regeneration and left for 30 seconds. The above folding and pressing action was carried out on the REGEN marked line and the sample left for 2.5 minutes to finish regenerating.

The sample was rinsed under running water for 20 minutes to neutralise the chemicals, placed in a 10% gylcerol solution bath for 10 minutes and finally stretched between two standard embroidery hoops.

The stretched samples were then dried in a standard laboratory oven until dry at 105° C.

The samples were reverse mounted (viscose on back of sheet) to exemplify any stress fracture lines caused and/or body penetration issues.

Figure 2:
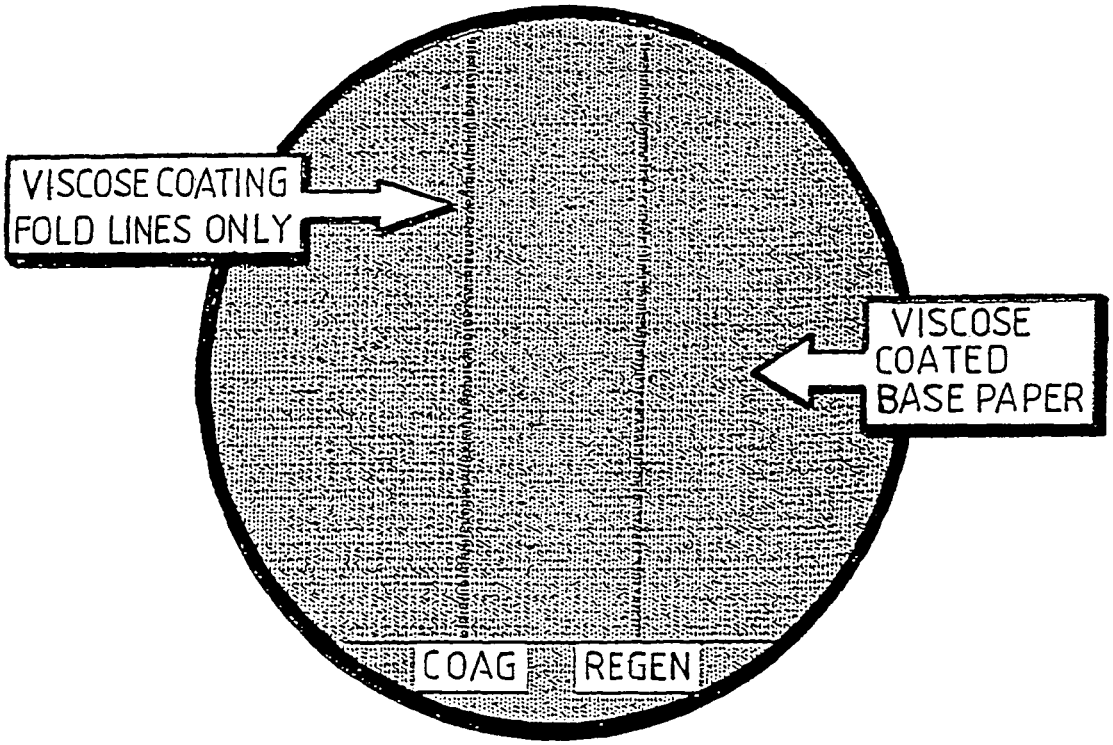
Figure 3:
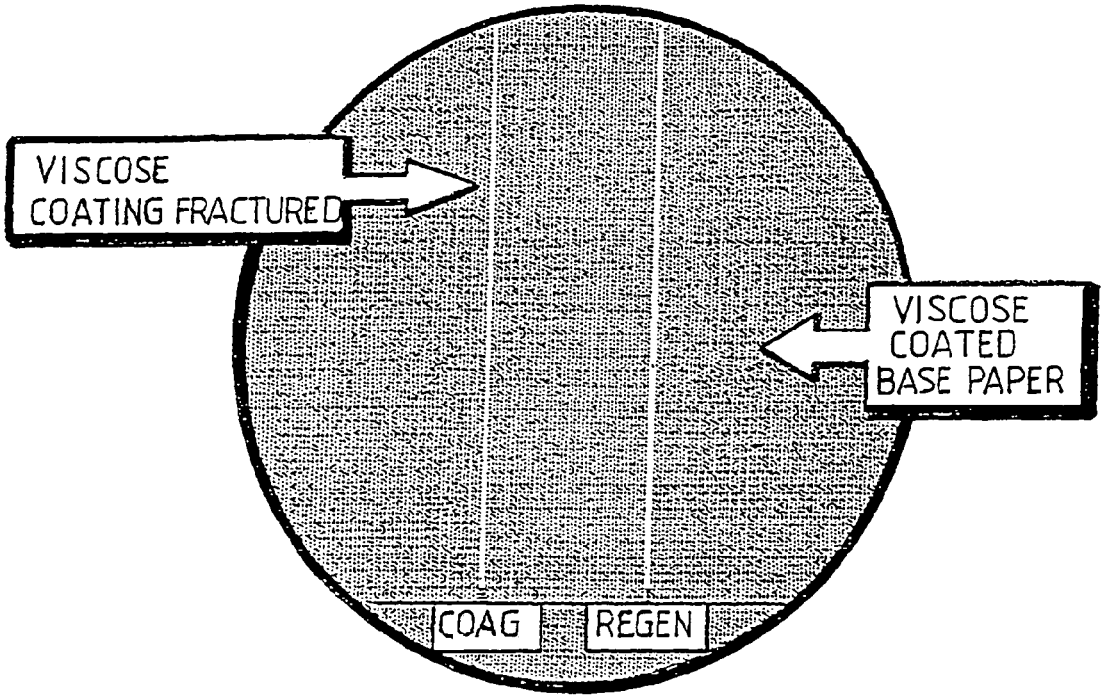

The results of the tests are shown in FIGS. 1-3 of the accompanying drawings which relate respectively to paper samples (i)-(iii) identified above.

It will be seen that no fracture lines developed in paper (i) (i.e. a paper in accordance with the invention) which emulated a paper (ii), i.e. one with typical viscose binder system. In contrast, paper (iii) (which utilised a non-viscose binder, i.e. poly(vinyl alcohol)) gave fracture lines.

EXAMPLE 4

Paprical Bristow Viscose Penetration Analysis

The test was conducted using a Paprical Bristow dynamic sorption unit supplied by Optest Equipment Inc. of Canada.

The test equipment utilises the Lucas Washburn theory of the rate of sorption of water into a porous structure of paper, which should be proportional to the square-root of the time available for sorption.

This test was carried out on the following samples of paper:

(iv) a dialdehyde bonded paper;

(v) a first poly(vinyl alcohol) bonded paper;

(vi) a second poly (vinyl alcohol) bonded paper;

(vii) the paper of Example 2;

(viii) a viscose bonded paper.

Figure 4:
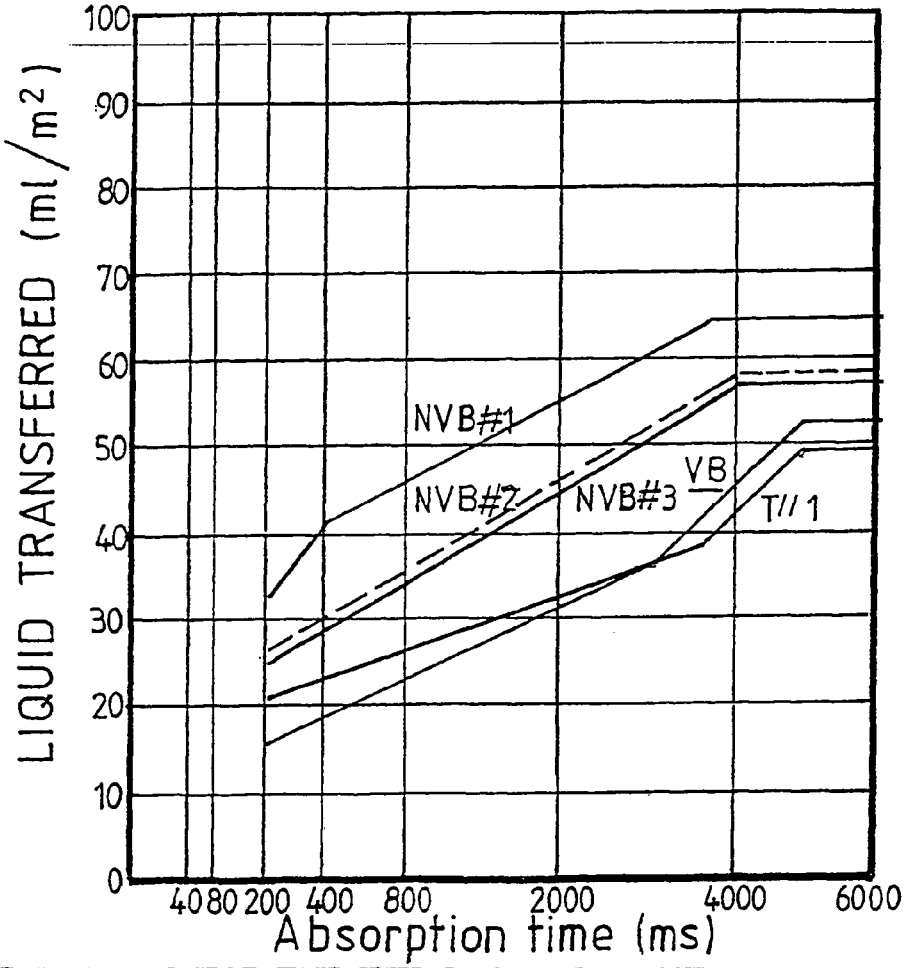
FIGS. 4-5 illustrate the results of the sorption analysis for Example 4.

The absorbency of each paper was determined by using the above equipment to evaluate the samples penetration by a viscose solution of a particular viscosity (3850 cp) over a range of application speeds measured in milliseconds. The results are shown in FIG. 4 in the form of an absorbency and contact time graph which can be used to determine absorbency differences between different materials. If conversion parameters such as production speed and viscose viscosity are known then the unit's viscose contactant can be adjusted to predict the conversion potential of the base material in the casing conversion environment.

Figure 5:
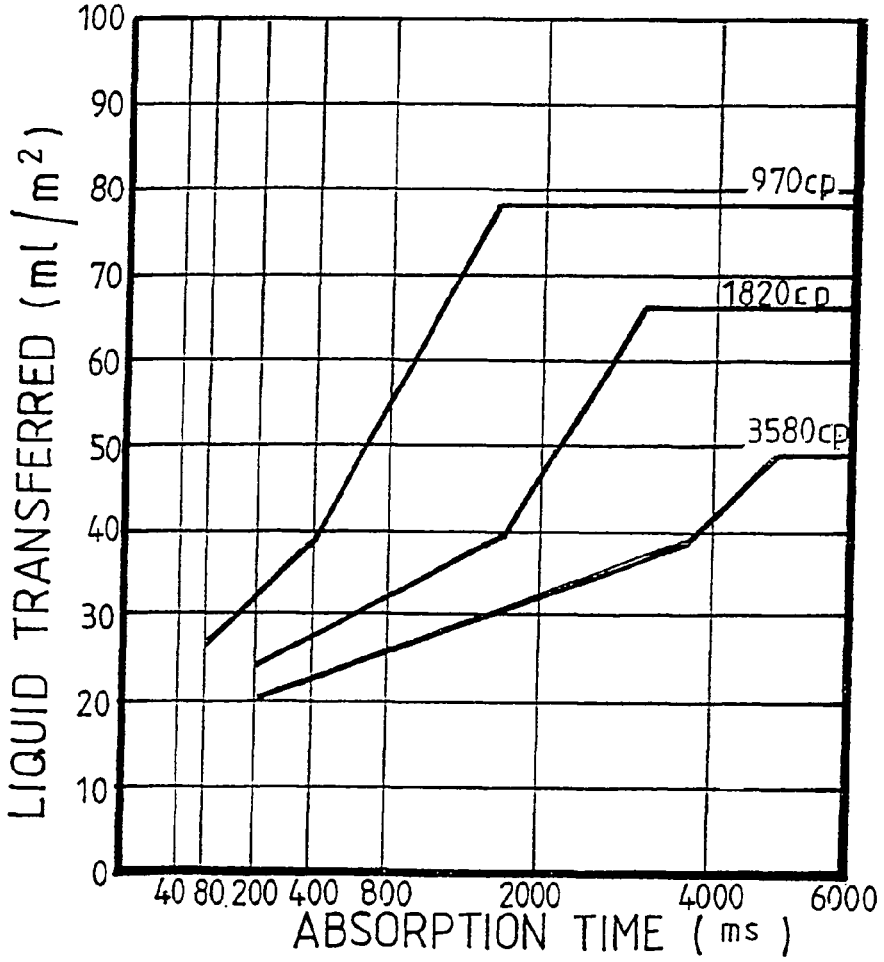

Furthermore, the test was carried out on paper (vii) (i.e. the paper in accordance with the invention) for a range of viscose solutions of different viscosity each at a range of application speeds. The results are shown in FIG. 5.

The invention claimed is:

1. A method of producing a porous bonded fibrous sheet material comprising (i) treating a porous fibrous substrate which is comprised of cellulosic fibres and which has a moisture content of less than 10% by weight with an unsubstituted galactomannan gum and a cross-linkable wet strength resin both dissolved in water, said treatment being effected otherwise than with a latex;

(ii) removing excess water; and (iii) effecting cross-linking of the resin by heating the substrate to a temperature above 1000° C.

2. A method as claimed in claim 1 wherein the porous fibrous substrate has a moisture content of less than 5% by weight.

3. A method as claimed in claim 2 wherein the porous fibrous substrate has a moisture content of 3-5% by weight.

4. A method as claimed in claim 1 wherein the total amount of the gum and wet strength resin applied to the porous substrate is 1 to 10% by weight of the untreated substrate.

5. A method as claimed in claim 1 wherein the amount of the wet strength resin applied to the substrate is 0.05 to 2% by weight of the untreated substrate.

6. A method as claimed in claim 1 wherein the amount of gum applied to the substrate is 0.05% to 3% by weight of the untreated substrate.

7. A method as claimed in claim 1 wherein the gum is non-ionic.

8. A method as claimed in claim 1 wherein the gum is a vegetable gum.

9. A method as claimed in claim 1 wherein the gum is guar gum.

10. A method as claimed in claim 1 wherein the gum is locust bean gum.

11. A method as claimed in claim 1 wherein the wet strength resin is a water soluble cationic epichlorohydrin-polyamide resin.

12. A method as claimed in claim 1 wherein the porous fibrous substrate is treated with an aqueous solution which contains both the gum and the cross-linkable wet strength resin dissolved in water.

13. A method as claimed in claim 1 wherein the porous fibrous substrate is a wet-laid material.

14. A method as claimed in claim 13 wherein the wet-laid substrate is a paper.

15. A method as claimed in claim 14 wherein the paper has a permeability of 100 to 200 $m^3$ $min^{-1}$ $m^{-2}$.

16. A method as claimed in claim 14 wherein the paper has a basis weight of 10 to 30 gsm.

17. A method as claimed in claim 14 wherein the paper has a tensile ratio of 0.5 to 2.0.

18. A method as claimed in claim 14 wherein the paper is prepared from "long" fibres having an aspect ratio of 300-3000.

19. A method as claimed in claim 14 wherein the paper is comprised of cellulosic fibres of the Musa Textilis species.

20. A method as claimed in claim 19 wherein the cellulosic fibres are Abaca.

21. A method as claimed in claim 14 wherein the paper is comprised wholly of cellulosic fibres.

22. A method as claimed in claim 14 wherein the paper is treated with an aqueous solution which contains both the gum and the cross-linkable wet strength resin dissolved in water and said solution is applied to the paper by means of a size press.

23. A porous bonded fibrous sheet material produced by the method of claim 1.

24. A food casing material which comprises the bonded fibrous sheet material in accordance with claim 23 treated with viscose.

25. A food casing material as claimed in claim 24 which comprises 200-400% by weight of viscose.

26. A food product comprising a food enclosed within a skin of a food. casing material in accordance with claim 24.

27. A food product as claimed in claim 26 wherein the food is a sausage or salami.

* * * * *